US006152683A

United States Patent [19]

Linder

[11] Patent Number: 6,152,683

[45] Date of Patent: Nov. 28, 2000

[54] METHOD, APPARATUS AND CONTAINER FOR SHIPPING PRINTED MATTER

[75] Inventor: Heinz Linder, Zofingen, Switzerland

[73] Assignee: Grapha-Holding AG, Hergiswil, Switzerland

[21] Appl. No.: 08/330,127

[22] Filed: Oct. 27, 1994

[30] Foreign Application Priority Data

Oct. 27, 1993 [CH] Switzerland ..... 03232/93

[51] Int. Cl.[7] ..... B65G 60/00

[52] U.S. Cl. ..... 414/801; 414/788.2; 414/795.6; 414/802

[58] Field of Search ..... 414/403, 788.2, 414/795.6, 786, 801, 802; 206/494, 507; 53/250, 539, 540

[56] References Cited

U.S. PATENT DOCUMENTS

| | | | |
|---|---|---|---|
| 1,690,920 | 11/1928 | Bergmann et al. . | |
| 3,283,955 | 11/1966 | Crabtree . | |
| 3,403,814 | 10/1968 | Asenbauer . | |
| 3,491,681 | 1/1970 | Saro, Jr. . | |
| 3,658,194 | 4/1972 | Gendron et al. . | |
| 3,734,341 | 5/1973 | Levenhagen | 206/507 |
| 3,773,213 | 11/1973 | Fredrick | 206/507 |
| 4,027,796 | 6/1977 | Martin | 206/507 |
| 4,214,743 | 7/1980 | Meier . | |
| 4,293,272 | 10/1981 | Jellema | 414/795.6 X |
| 4,829,742 | 5/1989 | Romagnoli | 53/540 X |
| 4,915,578 | 4/1990 | Becker | 414/795.6 X |
| 5,046,617 | 9/1991 | Focke et al. | 206/507 |
| 5,069,598 | 12/1991 | Kleinhen et al. | 271/207 X |
| 5,176,494 | 1/1993 | Nigrelli et al. | 414/795.6 |
| 5,344,021 | 9/1994 | Rose | 206/507 X |

FOREIGN PATENT DOCUMENTS

| | | | |
|---|---|---|---|
| 0067399A | 12/1982 | European Pat. Off. . | |
| 0 095 576 | 12/1983 | European Pat. Off. . | |
| 0263735 | 4/1988 | European Pat. Off. . | |
| 0 365 870 | 10/1989 | European Pat. Off. . | |
| 1363792 | 5/1964 | France . | |
| 0265601 | 3/1989 | German Dem. Rep. | 414/795.6 |
| 2715705 | 4/1977 | Germany . | |
| 2756473A1 | 12/1977 | Germany . | |
| 3104279 | 9/1982 | Germany . | |
| 3637610A1 | 11/1986 | Germany . | |
| 367750 | 4/1963 | Switzerland . | |
| 1281757 | 7/1972 | United Kingdom . | |
| 2082548 | 10/1982 | United Kingdom . | |
| 2116514A1 | 9/1983 | United Kingdom . | |

*Primary Examiner*—James W. Keenan
*Attorney, Agent, or Firm*—Venable; Robert Kinberg

[57] ABSTRACT

The invention relates to a method, an apparatus and a container for shipping printed matter. The method of the invention is essentially distinguished in that the printed matter reaches the respective shipping points in returnable containers adapted to its format. These returnable containers can then be used again after their return to the packaging station. The containers used in this connection are essentially distinguished in that they have free spaces extending from the container bottom to the upper container edge for access to printed matter to be placed in them. The apparatus of the invention to be used for packaging is distinguished by a magazine for receiving returnable containers stacked inside each other, from which the containers can be taken separately for loading with printed matter.

5 Claims, 8 Drawing Sheets

METHOD, APPARATUS AND CONTAINER FOR SHIPPING PRINTED MATTER

CROSS-REFERENCE TO RELATED APPLICATIONS

The present application claims the right of foreign priority with respect to Application No. 03232/93-9 filed in Switzerland on Oct. 27, 1993, the subject matter of which is incorporated herein by reference.

FIELD OF THE INVENTION

The invention relates to a method for shipping printed matter, in particular newspapers and magazines, to a distribution point wherein the printed matter is packaged in a packaging device and transported to the shipping point, a container usable for executing such methods for shipping of printed matter as well as an apparatus which can be used for the execution of methods of the invention for ready-for-shipment packaging of printed matter.

BACKGROUND OF THE INVENTION

Printed matter, in particular newspapers and magazines, removed from, for example, an inserting machine or a collecting folder, is customarily first collected in fixed numbers in a stack before being shipped. For this purpose a so-called "stacker", for example, can be used for forming the stacks. The stacks of printed matter created in this manner are then customarily kept together in a bundle by means of a tie. In general, a plastic foil enclosing the stack is additionally used for preventing damage. These packages of printed matter ready for shipping are subsequently transported to the shipping points, where the ties are cut and, if required, the plastic foil is removed to allow re-packaging of the printed matter into new packages or the display of individual pieces of printed matter for sale.

With the above described customary methods, the material used for tying and the protective cover are discarded as non- reusable materials. Furthermore, the known methods are also disadvantageous in that elaborate tying devices are needed for preparing bundles ready for shipment from the individual pieces of printed matter lying loosely on top of each other. The production of bundles ready for shipment by means of these tying devices furthermore requires considerable time. Finally, even with the use of plastic foil covers, which increase the amount of non-reusable materials used, for the tied packages of printed matter, only limited protection is achieved during loading and unloading of transport vehicles and during the transport itself.

SUMMARY OF THE INVENTION

In view of the above described disadvantages of the known shipping methods, it is the object of the invention to provide an environmentally friendly shipping method for printed matter, by means of which it is simultaneously possible to assure the rapid and damage-free shipment of printed matter from the place where it is produced to the point of sale, as well as to recite a container suitable for executing the method and a suitable apparatus for packaging the printed matter.

Regarding the method, this object is attained by means of a method of the type mentioned at the outset in that packaging takes place by placing the printed matter on a deposit surface adapted to its size on the bottom of essentially rigid containers, wherein an essentially lateral shifting of the deposited printed matter is prevented by means of lateral pieces extending from the lateral edges of the deposit surface, and that transport takes place in these containers, from which the printed matter is removed at the shipping point, after which the return of the containers to the packaging device takes place.

By employing the essentially rigid containers, the production of ready-for-shipment printed matter is made possible by means of simply depositing the printed matter on the container bottom. Thus, the removal of printed matter from the containers at the intermediate storage or sales points does not require the destruction of or damage to the containers used for packaging, so that they can be used again after they have been returned to the packaging device. As a result it is possible to considerably reduce the waste occurring in the course of shipping printed matter by employing the method of the invention, which results in an increase in the environmental compatibility of the method.

By means of the essentially rigid containers with lateral pieces extending from lateral edges of a deposit surface on its bottom and adapted to the format of the printed matter, which prevent an essentially lateral shifting of the deposited printed matter, it is furthermore possible to achieve the damage-free loading on and unloading from transport vehicles of the printed matter placed in the containers as well as a reduction of the risk of damage during transport. In particular, damage to the printed matter by unintended effects from the outside is prevent by the use of the essentially rigid containers. By means of the disposition of the lateral pieces of the container adapted to the format of the printed matter, damage to the printed matter because of lateral shifting inside the container is assuredly prevented. The last mentioned effect can be achieved by adapting the deposit surface to the format of an individual piece of printed matter or by adapting the deposit surface to the format of several adjacently placed pieces of printed matter.

As already mentioned above, the essentially rigid containers permit the production of ready-for-shipment packages of printed matter by simply depositing them on the bottom of the containers. In connection with the method of the invention it is therefore possible to omit the employment of an elaborate tying device, because of which the shipping costs are reduced on the one hand and on the other shipment can be speeded up.

In a preferred embodiment of the method, the containers are stacked inside each other for the return to the packaging device. By means of this it is possible to better utilize the capacity of the vehicles used for the return, which further increases the environmental friendliness of the method.

While the return of the containers preferably takes place with the containers stacked inside each other, the containers loaded with printed matter are transported in a particularly preferred manner by being stacked on top of each other. Because of this it is possible to prevent damage of the printed matter on the top of the individual containers by means of the bottom of another container seated on it during transport in a manner where they are stacked inside each other and thus the transport safety can be further increased.

The speed of the method in accordance with the invention can be further increased if the printed matter is transferred for packaging into the containers directly from the outlet of a processing unit used for producing it, for example an inserting machine or a collecting folder, in a regular formation, in particular as a stream of pieces placed on top of each other in a fish-scale pattern, to an essentially vertically extending supply chute of the packaging device, through which they reach the container placed in readiness underneath it either individually or as stacks formed from a selectable number of pieces of printed matter.

In this embodiment of the method all pieces of printed matter reaching the container generally have the same orientation in respect to the container bottom. Therefore the folded edges of the individual pieces of printed matter lie on top of each other, which results in uneven loading of the container. This defect, which results in a reduction of the environmental compatibility of the shipping method because of the unsatisfactory utilization of the transport capacity of vehicle used for transport, can be remedied in a preferred embodiment of the shipping method of the invention in that the container is turned at least once around an axis essentially extending vertically to its bottom between the deposit of successive pieces of printed matter. It can be achieved by means of this that the folded edges of the individual pieces of printed matter do not all come to rest on top of each other, because of which a more even loading of the containers and in the end an increase in the environmental compatibility of the shipping method is achieved.

When shipping conventional pieces of printed matter having a rectangular format it suffices if the container is turned once by 180° after being half loaded. However, when particularly high containers are used, several turns are contemplated during a loading process.

The use of a particularly space-saving apparatus for the ready-for-shipment packaging of the pieces of printed matter in the containers in the course of the method of the invention is achieved if the containers are supplied to the packaging device in a form where they are stacked inside each other, which then respectively removes individual ones for loading with printed matter.

Regarding the container, the object of the invention is attained by a container usable in connection with the method in accordance with the invention for shipping printed matter, which has an essentially rigid bottom with essentially rigid lateral pieces extending therefrom, which is essentially distinguished in that the lateral pieces extend, starting from lateral edges of a deposit surface adapted to the format of the printed matter on the bottom to the upper container edge and that their inner surfaces form resting surfaces which essentially prevent a lateral shifting of the printed matter placed on the deposit surface. In this case a free space extending from the bottom to the upper container edge is provided between at least two resting surfaces for easier access to the printed matter placed into the container.

A damage-free transport of the printed matter can be assured by this embodiment of the containers. It is furthermore possible because of the formation of the free space intended for access to assuredly prevent damage to the printed matter when taking it out of the containers at the shipping points, since for taking the pieces of printed matter out of a container designed in this way they can be grasped without difficulty by their edges located in the area of the free space.

A particularly simple removal of the printed matter from the container is possible if in the area of two oppositely situated lateral edges of the deposit surface respectively one of the free spaces is disposed between the lateral pieces.

Damage to the pieces of printed matter lying in the containers in accordance with the invention can be prevented in a particularly dependable manner if the free space is bounded on its side facing away from the printed matter by further lateral pieces which extend upward, starting from areas located outside the deposit surface of the container bottom. By means of the further lateral pieces it is possible to prevent in the area of the free spaces unintended lateral action from the outside on the printed matter deposited in the container. At the same time simple access to the printed matter is possible by the formation of free spaces open at the top between the insides of the further lateral pieces and the lateral edges of the printed matter lying in the container.

In a particularly preferred embodiment of the containers, the further lateral pieces extend from lateral edges of a second deposit surface adapted to the format of the printed matter on the bottom and are arranged in such a way that their interior surfaces provide a resting surface which prevents an essentially lateral shifting of printed matter deposited on the second deposit surface.

Containers of this type can be employed in a particularly versatile manner if the second deposit surface has a different format from that of the first.

A particularly dependable protection of the printed matter deposited in the container can be achieved if at least in the area along one of the lateral edges of one of the deposit surfaces the lateral pieces extending from there form a continuous lateral wall of the container.

The safe transport of stacks of printed matter, whose height is less than the height of the container, in containers of the invention can be achieved if notches, which permit the securing of stacks of printed matter of different height on the container bottom by means of tying, are provided which, in the area of opposite lateral edges of the deposit surface, extend from the upper container edge.

Space-saving return of containers in accordance with the invention from the shipping point of the printed matter is made possible if they have a shape permitting them to be stacked inside each other.

For this, the container is suitably embodied in such a way that an area adjoining the bottom of its lateral wall extending from the bottom to the upper edge of the container can be received in the upper area of the interior of a container of the same type.

This can be achieved, for example, if at least two lateral pieces of the container form an obtuse angle with the container bottom.

As already discussed above, a particularly safe transport of the printed matter can be realized if the containers used for shipping have a shape so that they can be stacked on top of each other. For this purpose the upper container edge is embodied in a suitable manner as a receiver for the laterally non-shiftable placement of a container of the same type.

It is particularly preferred if the containers can be stacked inside as well as on top of each other.

Customarily the container bottom is shaped approximately rectangular and the lateral pieces enclose an essentially cuboid volume. By means of this shape it is possible to utilize the transport capacity of the vehicles usable for container transport in a particularly efficient way.

It is particularly advantageous for loading and unloading the containers if an outwardly projecting, preferably circumferential handling strip is formed on the upper container edge. It can be simultaneously used for supporting the containers stacked inside each other on each other. This is particularly advantageous for preventing a jamming effect between the containers stacked inside each other and having lateral pieces which form an obtuse angle with the container bottom.

As already described above, generally uneven loading is provided when packaging printed matter in shipping containers, which can be evened out by turning the container around an axis extending approximately vertically in relation to its bottom between the deposit of successive pieces of printed matter. For this purpose at least one receptacle for a coupling fixed against relative rotation with a turntable, which is rotatable around an axis extending vertically in relation to the container bottom, can be disposed on the bottom of the container of the invention for shipping printed matter.

The receptacle is advantageously embodied as a through-opening in the container bottom, by means of which it is possible to prevent the formation of air cushions when introducing printed matter into the container as well as the creation of under pressure when separating the containers stacked inside each other or when taking printed matter out of the container.

For loading with printed matter, the containers of the invention are generally transported on conveyor belts to a loading device. A guide device for guiding the container along guide means of a transport device used for displacing the container is preferably disposed on the container bottom for guiding the container during transport in an orientation suitable for loading it.

The guide device can be formed in a particularly simple manner by a guide groove in the container bottom.

If the walls of the guide groove form a strip extending into the container interior, it is possible through lateral vents to rapidly disperse dammed up air caused by printed matter or stacks of printed matter falling into the container.

A particularly dependable guidance during lateral container shifting is achieved if the guide device has at least two parallel guide grooves.

Regarding the apparatus, the object of the invention is attained by means of a device for the ready-for-shipment packaging of printed matter, having a device for loading the printed matter individually or in stacks into a container and a device for conveying the printed matter to the loading device, which is essentially distinguished in that a magazine for receiving of a number of essentially rigid containers, which are adapted to the format of the printed matter and are stacked inside each other, is associated with the loading device, from which these can be individually taken by means of a separating device and can be transferred to a transport device for conveying the separated containers to the loading device.

This embodiment allows the placement of an apparatus for the ready-for-shipment packaging of printed matter on a small floor space, even if the previously described essentially rigid returnable containers are used as shipping containers.

A conveyor acting along the magazine can be used as the separating device, for example, which is provided with at least one holding device respectively acting individually on the containers stacked inside each other, by means of which the grasped containers can be transferred to the transport device. By means of the holding device designed to act on individual containers of the container stack, this embodiment permits the dependable separation of the containers stacked inside each other.

An apparatus in accordance with the invention can be housed on a particularly small floor space if the magazine is vertically disposed.

In this case the conveyor, on which gripping fingers used as the holding device are fixed for introduction between individual ones of the containers stacked inside each other, can be embodied to be encircling, wherein its lower end is disposed at a distance corresponding to at least twice the container height above the transport device. This embodiment permits the reliable separation of containers stacked inside each other, even if they have laterals pieces which form an obtuse angle with the container bottom, because it is possible to dependably prevent jamming by means of the introduction of the holding devices between the individual containers. Furthermore, with this embodiment it is possible to transfer the separated shipping containers to the transport device without further action by means of the force of gravity.

The device for transporting the separated containers preferably has at least one horizontally circulating conveyor belt.

Particularly dependable transport can be assured if catches used as stops for the shipping containers conveyed on the conveyor belt are fixed on the latter.

When using a transport device having two conveyor belts extending parallel at a distance from each other, at least one guide rail used for engaging a guide groove in the bottom of the shipping containers transported thereon can be fixed between the conveyor belts, by means of which the containers are guided in an orientation suitable for loading.

Further details and advantageous further developments of the apparatus of the invention for the ready-for-shipment packaging of printed matter and the containers of the invention for shipping printed matter will be described, making reference to the attached drawings to which attention is specifically invited at this point regarding all details not further described in the specification.

DETAILED DESCRIPTION OF THE PREFERRED EMBODIMENTS

Figure 1:
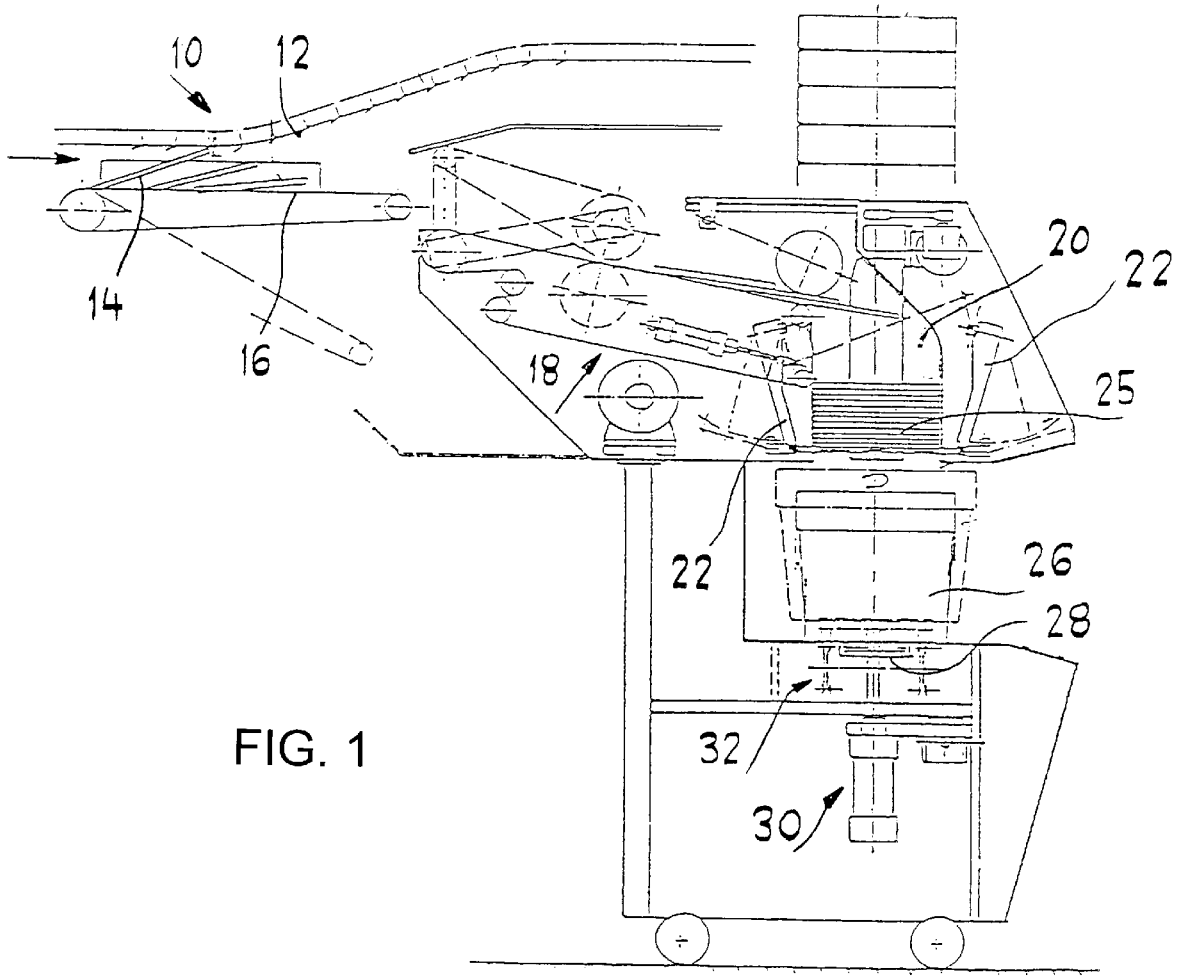
FIG. 1 is a lateral view of an apparatus in accordance with the invention.
Figure 2:
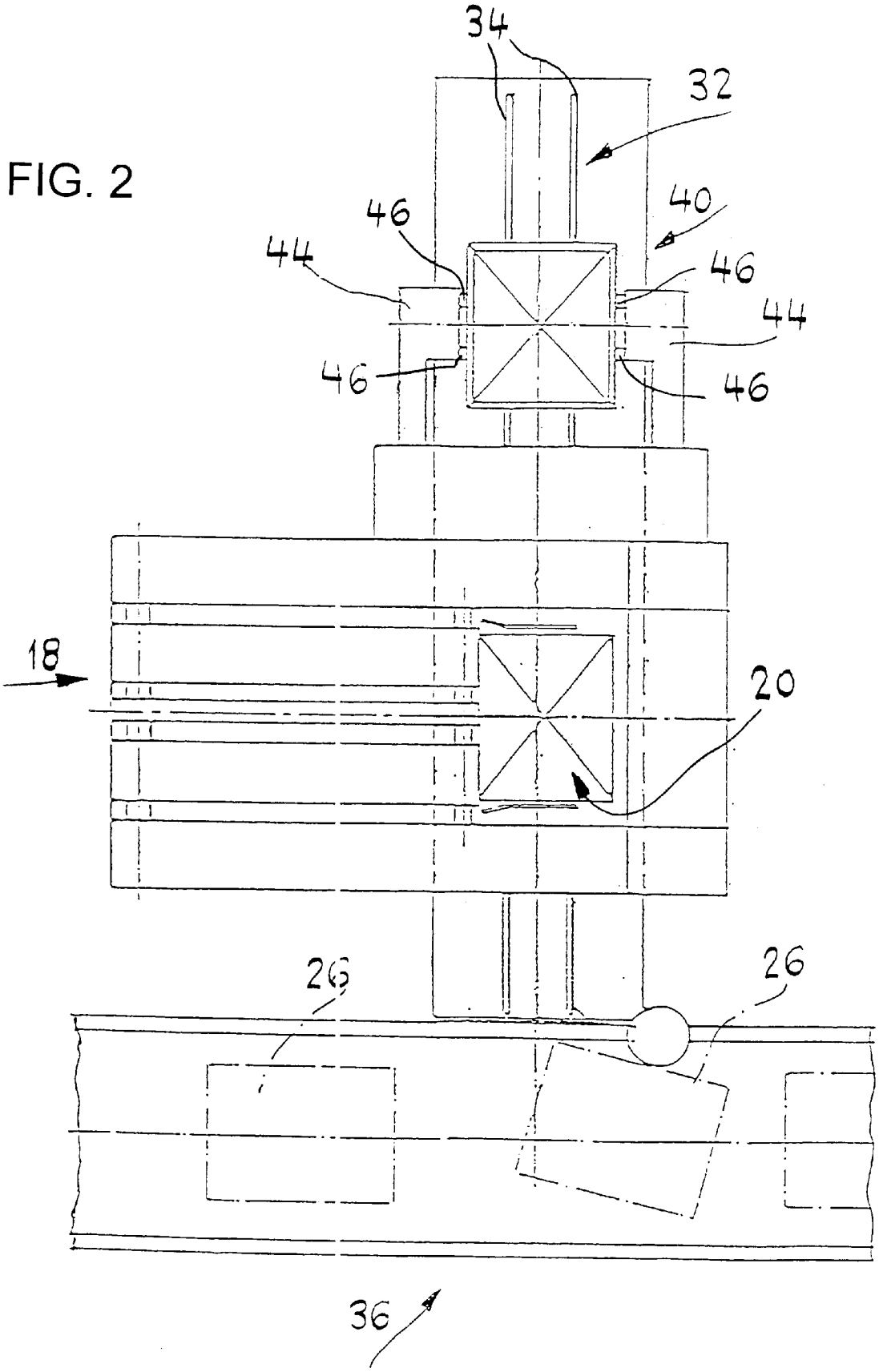
FIG. 2 is a top view of the apparatus of FIG. 1.
Figure 3:
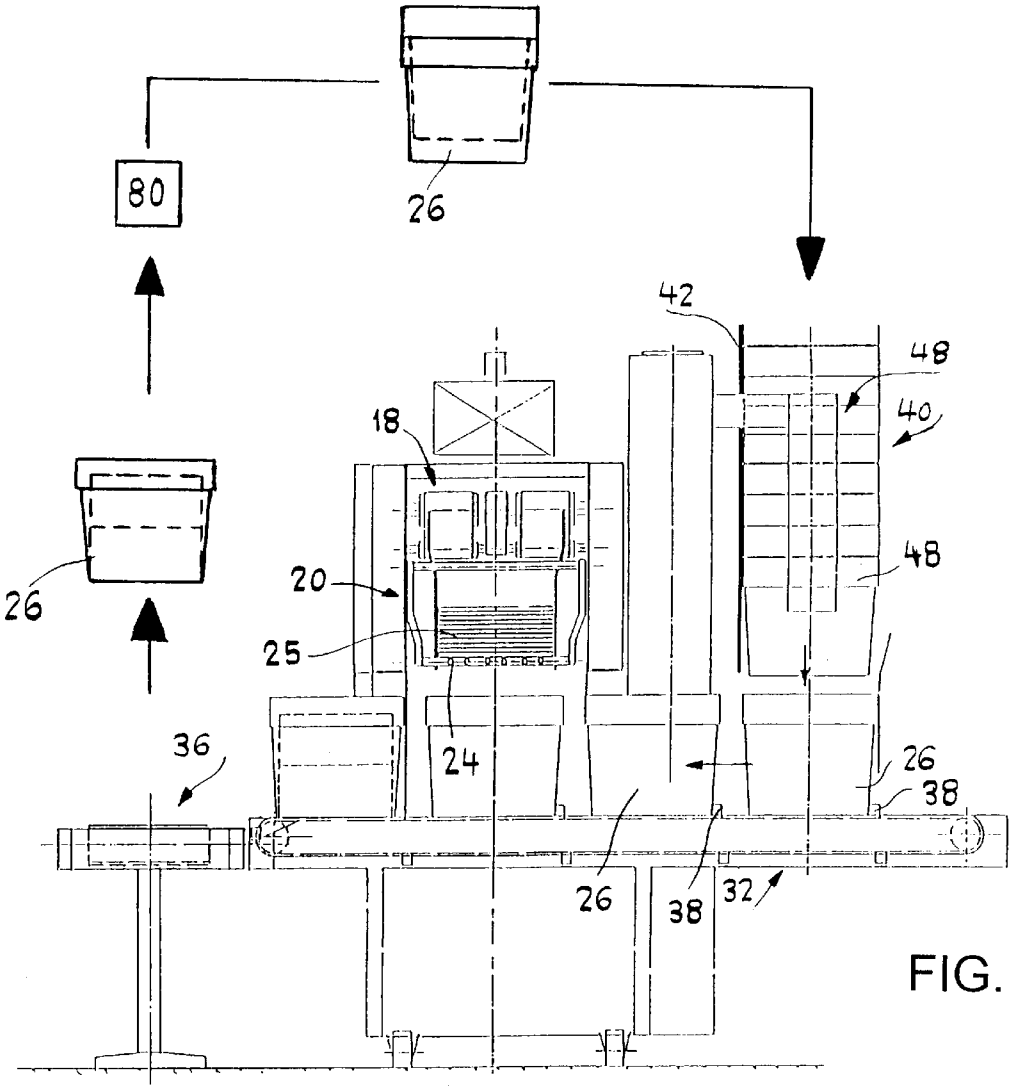
FIG. 3 is a front view of the apparatus of FIGS. 1 and 2.

An apparatus which can be used for executing a method in accordance with the invention for ready-for-shipment packaging of printed matter in containers suitable therefor is shown in FIGS. 1 to 3. As can be seen in FIG. 1 in particular, in the apparatus illustrated printed matter 14, transported by clamping devices 12 disposed on a transport device 10 to a conveyor belt 16 are dropped on the conveyor belt 16 and are transported by it to a folding machine 18. Together the conveyor belt 16 and the folding machine 18 form a conveying device terminating in a supply chute 20 of a device for loading printed matter into a container 26 placed thereunder.

The printed matter 14 dropped into the supply chute 20 at the end of the folding machine 18 forms a stack 25 of printed matter on the comb-like tines 24 of a stacking device 22 disposed in the interior of the supply chute, which can be introduced crosswise to the direction of the force of gravity into the lower area of the supply chute 20. To free the lower outlet of the supply chute 20, the comb-like tines 24 of the stacking device 22 can be removed from the interior of the supply chute 20, so that the stack 25 of printed matter previously placed on them can fall into a container 26 disposed underneath the supply chute 20. In the apparatus illustrated, the folding edges of the printed matter in the stack 25 of printed matter lie on top of each other. To make an even loading of the container 26 possible, a support disk 28 embodied as a rotating lifting platform is disposed below the supply chute 20. The support disk 28 can be brought into contact with the bottom of the container 26 by means of a lift piston device 30 or can possibly be introduced into a receptacle provided on the bottom of the container 26 for the coupling, fixed against relative rotation, of the container with the support disk in order to subsequently release the former from a transport device 32 used for transporting the container 26 underneath the supply chute 20. In the released state a turning movement of the container over 180° is possible, so that following the subsequent placement of the container 26 on the transport device 32 the folding edges of the printed matter falling into the shipping container 26 after its turning come to rest opposite the folding edges of the printed matter which had fallen into the shipping container prior to turning, whereby an even loading of the container 26 can be assured.

As can be seen particularly clearly in FIG. 2, the transport device 32 has two horizontal conveyor belts 34 extending parallel with each other at a distance, between which the support disk 28 can be brought to rest against the container bottom or can possibly be introduced into a receptacle disposed on the bottom of the shipping container 26.

In addition to the use of the lift piston device 30 for introducing the support disk 28 into the receptacle provided on the bottom of the container 26, it is also provided to lower the conveyor belts 34 in the area below the supply chute 20 by means of a lowering device in order to free the container 26 from the conveyor belts 34 and to make possible the turning of the container 26 which then rests on the support disk 28.

As can be seen particularly clearly in FIG. 2, after having been loaded with printed matter 14, the containers 26 can be transferred by means of the transport device 32 to a further conveyor belt 36, which then transports the loaded containers to a loading station. To assure safe transport of the containers 26 by means of the transport device 32, catches 38 are fixed on its conveyor belts 34 and form a stop for the containers 26 to be transported on them.

As shown in FIGS. 1 to 3, the apparatus of the invention has a vertically disposed magazine 40 for receiving the containers 26 stacked inside each other. The magazine 40 is bordered by a guide wall 42 and two oppositely disposed vertical conveyors 44. Gripping finger 46 are fixed on the vertical conveyors 44, as can be seen in FIG. 2, on which rest the lower edges of handling strips 48 which encircle the upper edges of the containers 26 received in the magazine and stacked inside each other. For transferring the containers 26 stacked inside each other in the magazine to the transport device 32, the gripping fingers with the vertical conveyors 44 are moved downward. When reaching the lower end of the vertical conveyor 44, the gripping fingers 46 forming the support for the handling strip 48 of the lowest container in the magazine 40 release this lowest container, so that it falls on the conveyor belts 36 by the action of the force of gravity. In this way it is possible to realize a particularly simple separation of the containers 26 stacked inside each other in the magazine. The distance of the lower end of the vertical conveyor from the conveyor belts 36 in this case approximately corresponds to twice the height of the container 26.

In the illustrated embodiment of an apparatus of the invention for the ready-for-shipment packaging of printed matter, the device for transporting the containers 26 extends approximately vertically to the direction in which the printed matter 14 is brought to the supply chute 20. If it is necessary for spatial reasons, however, an arrangement can also be used wherein the two transport devices extend parallel to each other.

As can further be seen from FIG. 1, the printed matter is dropped by the transport device 10 in a regular formation, namely as a stream of pieces placed on top of each other in a fish-scale pattern, on the conveyor belt 16, which forms a part of the device for conveying printed matter to the supply chute 20. In this way it is possible to assure a particularly rapid and safe transport of the printed matter to the supply chute 20, even with the interposition of the folding machine 18 between the conveyor belt 16 and the supply chute 20. The transport device can be used, for example, for transporting printed matter 14 from the end of an inserting machine or a collecting folder to the conveyor belt 16.

To assure the trouble-free operation of the apparatus of the invention, the functions of the transport device 10, the conveyor belt 16, the folding machine 20, the stacking device 22, the lift piston device 30, the transport device 32 and the vertical conveyors 44 are customarily adjusted to each other by computer control.

Advantageously, the printed matter 14 is transported in a container 26 to a distribution point 80, where the printed matter is removed prior to returning the container to the packaging device, as shown in FIG. 3.

Furthermore, the apparatus as a whole can be embodied as a mobile unit.

Figure 4:
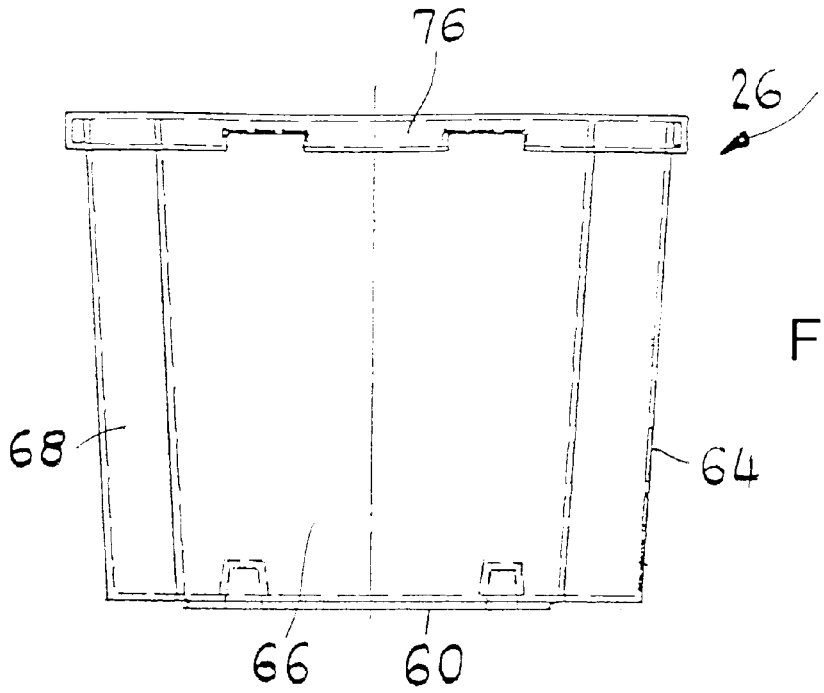
FIG. 4 is a lateral view of a first embodiment of a container of the invention.
Figure 5:
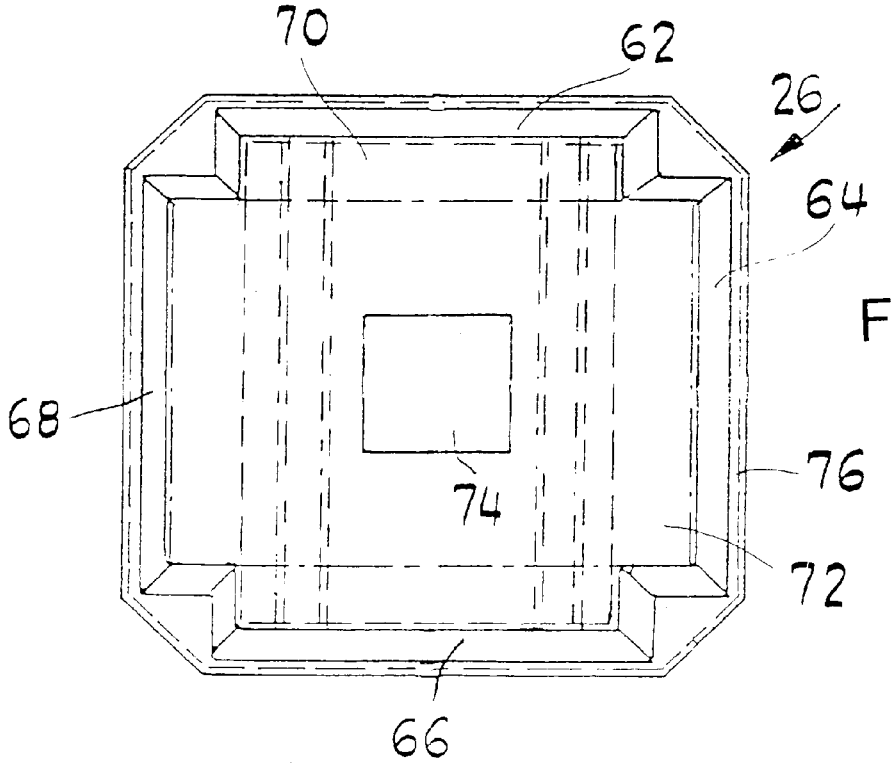
FIG. 5 is a top view of the container of FIG. 4.

Embodiments of containers in accordance with the invention intended for executing a method of the invention and for employment in an apparatus of the invention for the ready-for-shipment packaging of printed matter, in particular newspapers and magazines, will be described in what follows:

In accordance with a first embodiment represented in FIGS. 4 and 5, a container of the invention comprises a bottom 60 and, extending therefrom, lateral pieces 62, 64, 66 and 68, which respectively enclose an obtuse angle with the bottom 60. As can be seen particularly clearly in FIG. 5, the lateral pieces 62 and 66 extend from lateral edges of a deposit surface 70, which is adapted to the format of the printed matter to be placed into the container and indicated by dashed lines. In particular, the lateral pieces 62 and 66 extend over the entire length of the shortest edges of the deposit surface 70 and at their respective ends also cover the end areas of the longer lateral edges of the deposit surface 70.

In this way the inner surfaces of the lateral pieces 62 and 66 form resting surfaces along all lateral edges of the deposit surface 70 for printed matter to be placed on the deposit surface 70. In this way it is possible to prevent an essentially lateral shifting of the deposited printed matter in the container.

It has been shown that, in spite of the remaining shifting possibility of printed matter placed in the container because of the inclusion of the obtuse angle between the lateral pieces 62 and 66 and the bottom 60, particularly dependable printed matter shipment is achieved if the angle between the lateral pieces 62 and 66 and the bottom 60 is less than 100°, preferably approximately 95°. With an angle of less than 95°, printed matter to be placed into the container can jam and/or be bent between the lateral pieces 62 and 66 because of an insufficient "funnel effect".

A free space between the resting surfaces for the printed matter to be deposited into the container is respectively formed between the ends of the lateral pieces 62 and 66 extending from the end areas of the longer lateral edges of the deposit surface 70. The lateral edges of the printed matter to be deposited on the deposit surface 70 are free in the area of these free spaces, because of which a possibility of grasping the printed matter to be introduced into the container and for their easier removal from the container is created.

Between the ends of the lateral pieces 62 and 66, further lateral pieces 64 and 68 start outside of the deposit surface 70 and extend to the upper container edge. A free space, open at the top, which assures a simple removal of the printed matter, is bordered by the further lateral pieces 64 and 68 and by the printed matter placed on the deposit surface 70. On the other hand, the further lateral pieces 64 and 68 directly adjoining the lateral pieces 62 and 66 provide protection for the printed matter on the deposit surface 70 not enclosed by the lateral pieces 62 and 66. In the embodiment shown, a particularly good protection is achieved in that the lateral pieces constitute continuous lateral walls completely enclosing the container interior.

As can be further seen in FIG. 5, the further lateral pieces 64 and 68 extend from lateral edges of a second deposit surface 72 on the bottom 60, which corresponds to a second piece of printed matter indicated by dash-dotted lines. The embodiment of the further lateral pieces 64 and 68 in respect to the second deposit surface 72 completely corresponds to that of the lateral pieces 62 and 66 in respect to the first deposit surface 70. In this way it is achieved that an essential lateral shifting of printed matter placed on the deposit surface 72 is prevented by the lateral pieces 64 and 68 in a manner similar to that of the lateral pieces 62 and 66. Simultaneously, the deposit free from jamming and bending of printed matter on the second deposit surface 72 is assured and access to the printed matter placed thereupon is made easier. In this case the lateral pieces 62 and 66 delimit a free space, open to the top, for printed matter placed on the deposit surface 72. In the embodiment of a container illustrated in FIGS. 4 and 5, the deposit surfaces 70 and 72 correspond to the same printed matter formats. To increase the variability of such containers, i.e. to make possible the employment of the containers for executing a method of the invention for transporting printed matter of different formats, however, it has also been considered to use containers with two deposit surfaces of different formats. Furthermore, the use of deposit surfaces corresponding to the format of several pieces of printed matter placed next to each other has been considered.

Besides the option for the jam- and bend-free introduction of printed matter into the container of the invention, the embodiment of the lateral pieces 62 and 68 enclosing an obtuse angle with the bottom 60 also allows the stacking of several containers of the same shape inside each other. More exactly stated, this embodiment makes it possible that an area of the lateral wall of the container 26 extending from the bottom 60 to the container edge adjoining the bottom 60 and formed by the lateral pieces 62 to 68 can be received in the upper area of the container interior of a container of the same type, by means of which the capability of stacking them inside each other is assured in the end.

The outer contour of the container essentially corresponds to its inner contour in the exemplary embodiment illustrated, so that in general the exterior wall of a container to be stacked in a container of the same type disposed under it comes to rest completely against the interior wall of the container underneath. During the separation of containers stacked inside each other in this way the formation of under pressure between the individual containers is possible. Furthermore, it is possible that an air cushion is created between the individual containers when they are stacked inside each other. To avoid such disadvantages, a through-opening 74 is formed in the container bottom 60, which is simultaneously used for coupling, in a manner fixed against relative rotation, with the turntable 28 when introduced in an apparatus of the invention for the ready-for-shipment packaging of printed matter.

Furthermore, a handling strip 76, which projects toward the outside and extends around the upper container edge, is attached on the upper container edge and is intended to ease the transport of individual containers. At the same time the underside of the handling strip 74 forms a support for the gripping fingers 46 attached to the vertical conveyor 44 used as the separating device in the apparatus of the invention (see FIG. 3).

Support surfaces are furthermore formed by the handling strip 76, on which containers stacked inside each other can be supported. By means of this it is possible to reduce the risk of containers jamming when stacked inside each other, since with an appropriate embodiment of the handling strip 76 a hollow space between the exterior of one of the containers and the interior of a container placed under it is kept free during their stacking inside each other. When employing the apparatus of the invention, this can increase in particular the operational dependability of such an apparatus.

Finally it is noted in connection with this embodiment of the container in accordance with the invention, that the previously described advantages and effects can also be obtained if the lateral pieces 62 to 68 are connected via sections of an exterior surface of a truncated cone which is part of a circular cone, wherein these sections preferably rest tangentially on the longitudinal edges of the deposit surfaces 70 and 72, as shown by dotted lines in FIG. 5. By means of this embodiment it is possible to reduce the amount of material required for forming a container of the invention with given formats 70 and 72 and a given wall thickness. It is furthermore possible by such an avoidance of edges projecting into the container interior to reduce even more the risk of jamming of the containers when being stacked inside each other, while at the same time a placement free of shifting of the printed matter deposited in the container is assured.

An embodiment of a container in accordance with the invention, which can be stacked inside and on top of each other will be described below by means of FIGS. 6 to 10. As can be seen from FIG. 8, in this embodiment, too, lateral pieces 104 to 114, enclosing an obtuse angle with the container bottom 100, extend from the lateral edges of a deposit surface 102 on the container bottom 100, which is adapted to the format of a piece of printed matter and is indicated in the drawing by dashed lines, to the upper edge of the container (see FIGS. 6 and 7). The interior surfaces of the lateral pieces 104 to 114 form resting surfaces for the printed matter to be placed on the deposit surface 102 and which prevent an essentially lateral shifting of these pieces of printed matter in the container. For reasons already previously discussed, the angle between the lateral pieces 104 to 114 and the container bottom 100 is less than 100°, particularly preferred are approximately 95°. Free spaces are formed between the lateral pieces 114 and 104 or 108 and 110, which ease access to the printed matter to be placed on the deposit surface 102.

Figure 8:
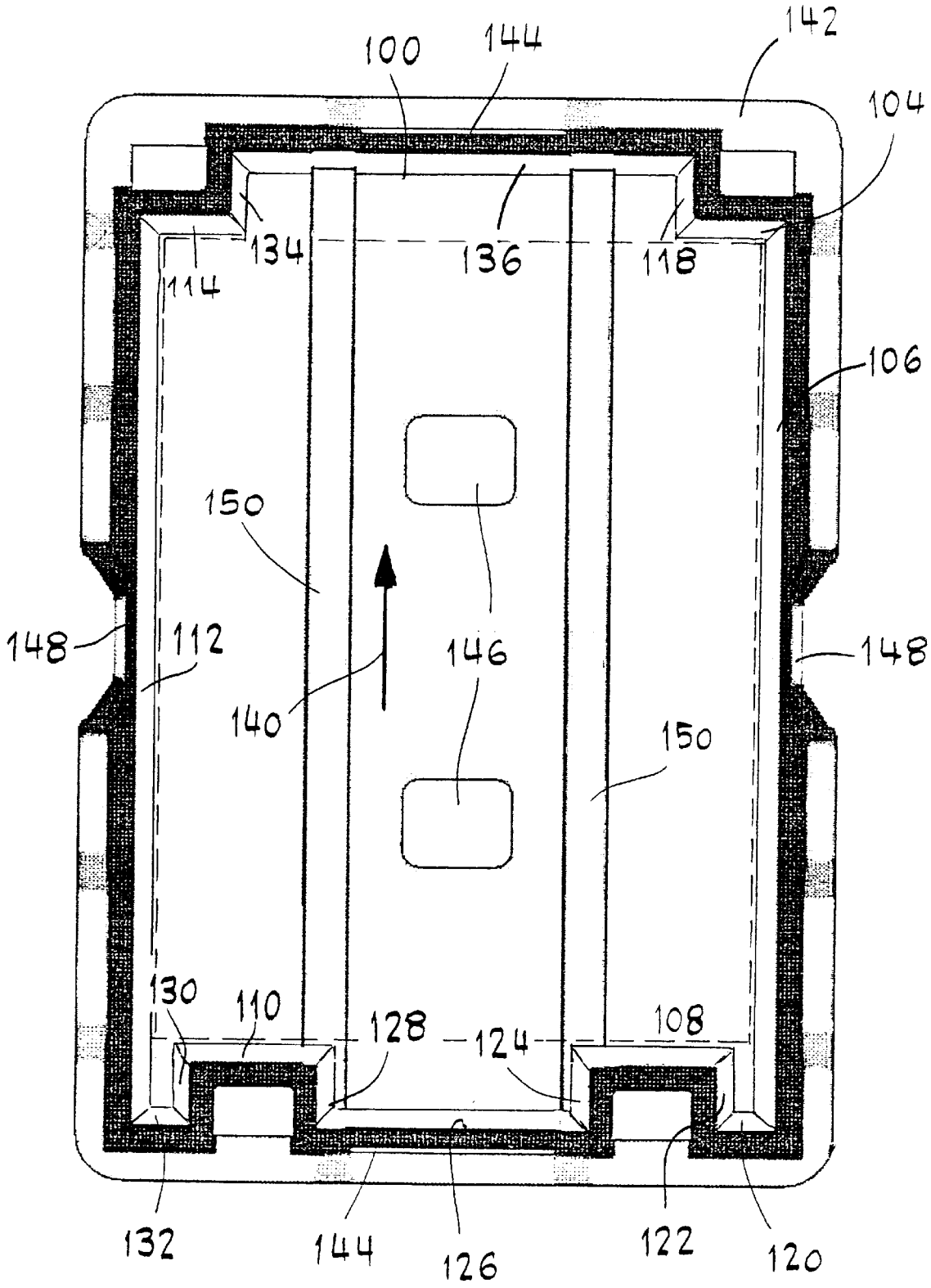
FIG. 8 is a top view of the container of FIGS. 6 and 7.

As can be furthermore seen from FIG. 8, the lateral pieces 104 and 114 extending from one of the shorter edges of the rectangular deposit surface 102 are disposed on the respective ends of this shorter edge, while the lateral pieces 108 and 110 associated with the other shorter lateral edge of the deposit surface 102 extend from the bottom 100, keeping a distance from the ends of this lateral edge. In this case the end of the lateral piece 114 (104) facing away from the lateral piece 112 (106) is offset in the direction toward the center of the shorter edge of the deposit surface 102 in relation to the end of the lateral piece 110 (108) facing the lateral piece 112 (106). By this arrangement of the lateral pieces 104 to 114 forming the resting surfaces for the printed matter to be placed into the container, together with the arrangement of further lateral pieces 118 to 136 connecting these lateral pieces with each other, it is made possible that containers of this type can be stacked inside each other as well as on top of each other, as will be explained below.

The further lateral pieces 118 to 136 extending from areas of the bottom 100 located outside the deposit surface 102 connect the lateral pieces 104 to 114 forming the resting surfaces for the printed matter to be placed on the deposit surface 102 in such a way that a lateral container wall is formed which is continuous in the circumferential direction. In the course of this a first free space, open at the top, is formed by the lateral pieces 134, 136 and 118, together with the corresponding lateral edges of the printed matter to be placed on the deposit surface 102, while a second free space, open at the top, located opposite the first free space is formed by the lateral pieces 124, 126 and 128, together with the corresponding lateral edges of the printed matter to be placed on the deposit surface 102. The second free space has a lesser width along the corresponding lateral edge of the deposit surface 102 than the first free space.

As can be seen in FIG. 8, the further lateral pieces 118 to 136 also enclose an obtuse angle of preferably less than 100°, particularly preferred of approximately 95°, with the bottom 100. It is assured by this that several containers of the same type can be stacked inside each other if they have the same orientation, as indicated by the arrows 140 in FIG. 9. On the other hand, the particular arrangement of the lateral pieces 104 to 136 makes it possible to stack several containers of the same type, but with alternating orientation 140 (see FIG. 10), on top of each other in such a way that the lateral pieces 106 and 112 of containers stacked on top of each other are approximately aligned with each other and that simultaneously the lateral pieces 136 of containers disposed in one orientation are aligned with the lateral pieces 120, 126 and 132 of containers of a different orientation which is turned by 180° in relation to the one orientation. In this way the container shape represented in FIG. 8 allows the stacking of several containers on top of each other to form a regular container stack, whose projection on the placement area corresponds to the projection of one of the containers on the placement area. In the process the lower edges of the lateral pieces 134, 136 and 118 come to rest against the upper edges of the lateral pieces 110, 128 and 108 of a container disposed below it, having an orientation turned by 180° in relation to the upper container. Furthermore, the lower edges of the lateral pieces 122 and 130 of the container on the top come to rest on the upper edges of the lateral pieces 114 or 104 of the container on the bottom. Thus, in the stacked position the edges of one of the lateral pieces forming a resting surface respectively rest against the edges of a further lateral piece.

Figure 9:
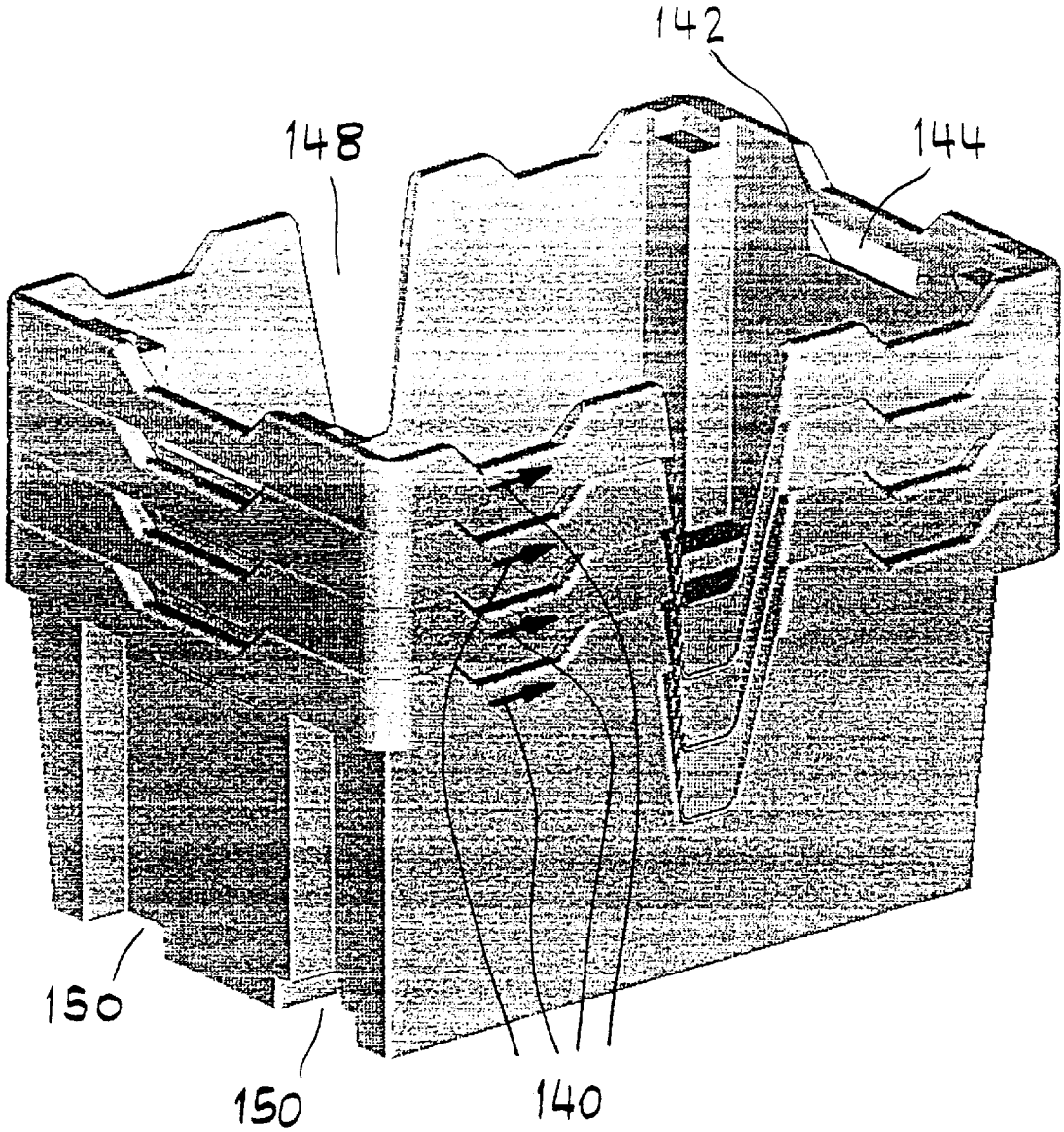
FIG. 9 is a perspective view of a number of containers of FIGS. 6 to 8 stacked inside each other.
Figure 10:
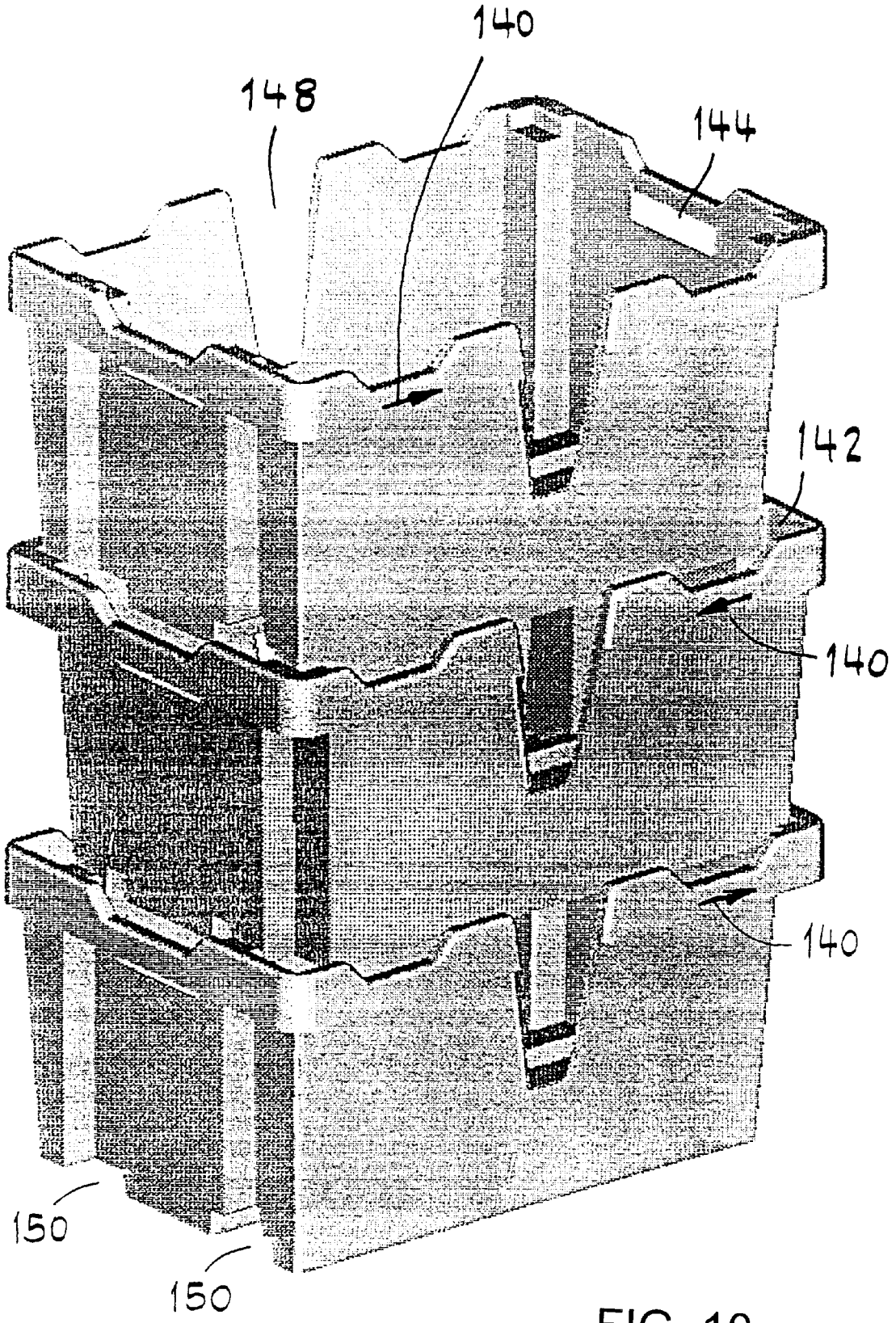
FIG. 10 is a perspective view of a number of containers of FIGS. 6 to 9 stacked on top of each other.

As can be seen particularly clearly in FIGS. 9 and 10, a handling strip 142 which projects outward and, in respect to the upper edges of the lateral pieces, also upward and essentially extends all around is provided on the upper container edge. In addition to the functions described in connection with the exemplary embodiment explained by means of FIGS. 4 and 5, a receptacle for the bottom of a container of the same kind to be stacked on it is realized by means of this arrangement of the handling strip in respect to the upper container edge, by means of which during stacking of the described containers a displacement of the upper container in respect to the container disposed under it can be prevented (see FIG. 10).

To ease the transport or separation of containers stacked on top of each other, recesses 144 forming transport handles are provided in the lateral pieces 126 and 136 in the embodiment shown in FIGS. 6 to 10. Furthermore, two through-openings 146 have been cut in the bottom of this container, which serve the same purpose as the through-opening 74 of the container of the invention in accordance with FIGS. 4 and 5.

In the execution of a method of the invention, the described container shape allows transport of printed matter in containers stacked on top of each other, wherein damage of the piece of printed matter respectively placed on top in one of the containers is prevented by the bottom of the container stacked on top of it, as well as the space-saving return of the containers to the packaging apparatus in stacked form after removal of the printed matter.

Figure 6:
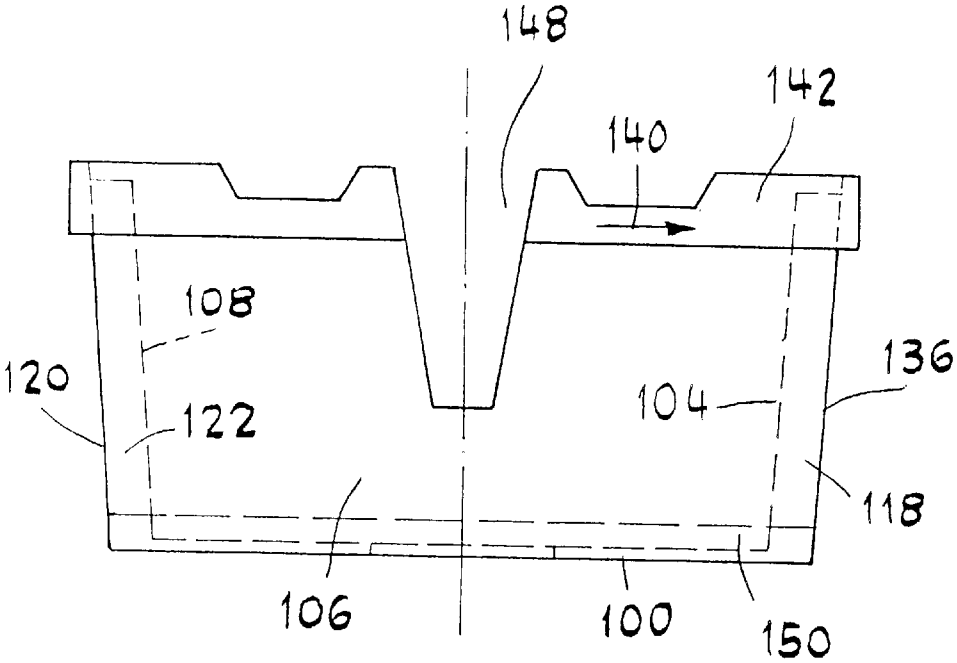
FIG. 6 is a lateral view of a second embodiment of a container of the invention.

To make possible the securing for transport of the printed matter placed on the deposit surface 102 it is possible to dispose recesses 148 extending from the upper edge of the lateral pieces 106 and 112 which are located opposite each other, which are provided for receiving a tie-down which presses the printed matter against the container bottom 100 (see FIG. 6).

Figure 7:
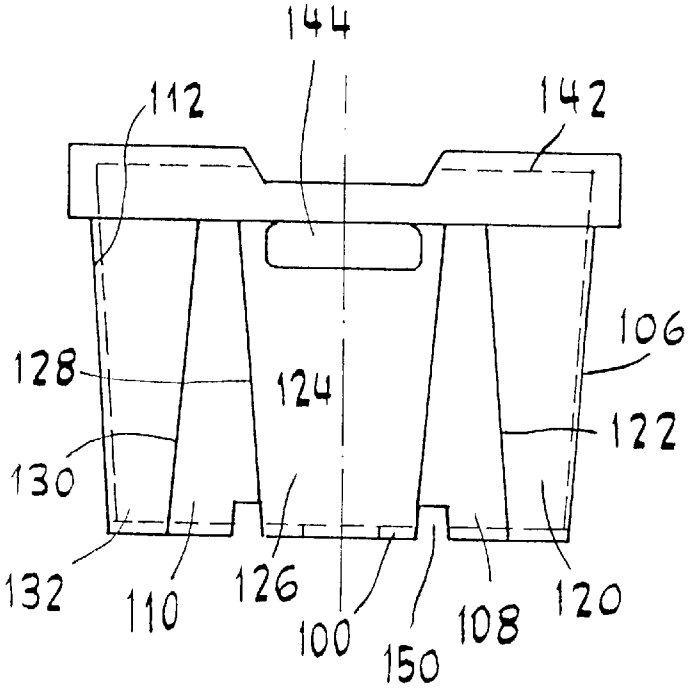
FIG. 7 is a further lateral view of the container of FIG. 6.

To increase dependability during loading of containers of the type represented by means of FIGS. 6 to 10 in an apparatus of the invention, a guide device formed by two guide grooves 150 extending parallel to each other is provided on the container bottom 100, as can be seen particularly clearly in FIG. 7. During transport on the conveyor belts 34 of the containers separated in the device consisting of a number of containers stacked inside each other and shown in FIGS. 1 and 3, these guide grooves can be used for receiving guide rails (not shown) disposed between the conveyor belts, in order to assure in this way the orientation below the supply chute 20 required for loading. The walls of the guide grooves 150 project into the container interior for forming a resting strip therein in order to assure in this way a particularly rapid removal by means of a lateral venting of an air cushion created by the pieces of printed material falling into the container.

The containers described by means of FIGS. 4 to 10 are essentially cube-shaped, because of which a space-saving transport of containers stacked inside and/or on top of each other is made possible. However, different container shapes are conceivable for shipping printed matter of other formats, for example essentially circular-cylindrical container shapes. For reasons of cost and to reduce their weight, the containers are preferably made of plastic. However, it is also conceivable to use containers made of a different material, for example metal, for shipping printed matter. Incidentally, it should also be noted that besides loading the containers in a device illustrated by means of FIGS. 1 to 3 it is also conceivable to supply the pieces of printed matter to the containers by means of a conveying rotor, which takes them individually from the transport device and is provided with transfer grippers or pocket-shaped compartments on its circumference, via the supply chute, through which the pieces of printed matter can fall downward flat.

When using containers which can only be stacked inside each other it is furthermore conceivable to use a lid adapted to their shape for closing containers loaded with printed matter during transport to intermediate storage and/or sales points in order to prevent damage of a piece of printed matter lying on top in a container by the bottom of a container stacked on it. Finally, with containers of the type illustrated in FIGS. 6 to 10 it is also possible to employ lateral pieces having the shape of a section of a circular cone in place of the lateral pieces 114, 134 or 118, 104 for reducing the material required for producing the containers.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A method for shipping printed matter packaged by a packaging device to a distribution point, comprising the steps of:

providing a plurality of essentially rigid containers of like construction, each having a bottom that includes a deposit surface for the placement of the printed matter, the deposit surface having lateral edges and having a size delimited by the lateral edges that corresponds essentially to a size of the printed matter;

supplying the containers stacked inside each other and symmetrically arranged about a common axis in a like orientation to the packaging device;

removing a respective individual container from the stacked containers;

placing the printed matter on the deposit surface of the respective individual container;

preventing lateral shifting of the printed matter on the deposit surface by providing lateral pieces extending from the lateral edges of the deposit surface;

transporting the printed matter in the respective individual container to the distribution point;

removing the printed matter at the distribution point;

stacking the individual containers inside each other and symmetrically arranged about a common axis in a like orientation; and returning the stacked containers of said stacking step to the packaging device.

2. A method in accordance with claim 1, further comprising the step of transporting the containers, loaded with printed matter, stacked on top of each other.

3. A method in accordance with claim 1, further comprising the steps of transferring the printed matter from an outlet of a processing unit to a supply chute of the packaging device, the processing unit being used for producing the printed matter as a stream of pieces placed on top of each other in a fish-scale pattern, and the supply chute extending essentially vertically; and placing a selectable number of pieces of printed matter into the container, the container being placed underneath the supply chute.

4. A method in accordance with claim 3, further comprising the step of turning the container at least once around an axis between depositing successive pieces of printed matter into the container, the axis extending essentially vertically to the bottom of the container.

5. A method in accordance with claim 4, wherein the container is turned by 180° around the axis.

* * * * *